United States Patent [19]

Hentschel et al.

[11] 4,212,816

[45] Jul. 15, 1980

[54] CARBOXYLIC ACID ESTERS OF PENTAERYTHRITOL

[75] Inventors: Karl-Heinz Hentschel; Rolf Dhein; Hans Rudolph, all of Krefeld; Karl Nützel, Neulussheim; Klaus Morche, Mannheim; Wolfgang Krüger, Schwetzingen, all of Fed. Rep. of Germany

[73] Assignee: Bayer Aktiengesellschaft, Leverkusen, Fed. Rep. of Germany

[21] Appl. No.: 971,389

[22] Filed: Dec. 20, 1978

[30] Foreign Application Priority Data

Dec. 29, 1977 [DE] Fed. Rep. of Germany ..... 2758780

[51] Int. Cl.[2] ..... C09F 5/08; C10M 1/24

[52] U.S. Cl. ..... 260/410.6; 252/56 S

[58] Field of Search ..... 260/410.6; 252/56 S

[56] References Cited

U.S. PATENT DOCUMENTS

| | | | |
|---|---|---|---|
| 2,991,297 | 2/1961 | Cooley et al. | 260/410.6 |
| 4,053,491 | 10/1977 | Koch et al. | 260/410.6 |
| 4,061,581 | 12/1977 | Lclen et al. | 260/410.6 |

FOREIGN PATENT DOCUMENTS

| | | | |
|---|---|---|---|
| 250649 | 6/1961 | Australia | 252/56 S |

OTHER PUBLICATIONS

Bohner, G. et al., J. of Chem. and Eng. Data, vol. 7, No. 4, pp. 547–553.

*Primary Examiner*—John F. Niebling
*Attorney, Agent, or Firm*—Connolly and Hutz

[57] ABSTRACT

An ester base stock which comprises pentaerythritol, cyclohexyl carboxylic acid, isostearic acid and at least one other $C_6$–$C_{16}$ saturated aliphatic monocarboxylic acid, having low volatility, a high flashpoint, and increased basic viscosity as well as a very high viscosity index.

1 Claim, No Drawings

CARBOXYLIC ACID ESTERS OF PENTAERYTHRITOL

This invention relates to carboxylic acid esters of pentaerythritol and to the use thereof in lubricants.

The practical requirements which lubricants have to satisfy have recently increased to such an extent that, in many cases, they may no longer be satisfied by mineral oil lubricants. Accordingly, synthetic lubricants are used for lubricating machine elements and engines in which the lubricant is subject to particularly severe stressing, for example in turbine engines of the type used in aircraft. The synthetic lubricants used for this purpose are in particular carboxylic acid esters.

Lubricating oils based on carboxylic acid esters are generally superior to mineral oils having the same basic viscosities in that they have higher flash points, lower volatility and a better viscosity-temperature characteristic (as measured by the viscosity index "V.I."). Lubricating oils, the base oils of which are distinguished by a basic viscosity of more than 10 cSt/100° C., low volatility, high viscosity indexes ("VI-values"), cold setting points below 0° C. and very high flash points, are required for lubricating machine elements which are subjected to operating temperatures of greater than 170° C. Accordingly, there is a need for ester oils which largely satisfy all these requirements.

So-called "complex esters" which, in addition to diols/polyols, also contain monohydric alcohols, dicarboxylic acids and/or moncarboxylic acids as esterification components are known. Although they enable ester oils having increased basic viscosity to be obtained., it is well known among those skilled in the art that the production thereof is complicated by the presence, after the esterification reaction, of fractions of acid and partial esters of dicarboxylic acids which may only be removed with difficulty by refining or distillation.

The use of carboxylic acids containing from 14 to 22 carbon atoms per molecule which are preferably branched in the $\alpha$-position to the carboxyl group as sole carboxylic acid components is also proposed in German Offenlegungsschrift No. 2,302,918 for the production of ester oils of relatively high viscosity, but unfortunately the starting moncarboxylic acids are not easy to obtain and require additional synthesis steps. Oils of this type still show considerable evaporation losses under highly oxidising conditions. Nor do these oils quite reach the necessary high viscosity index values of more than 140.

German Offenlegungsschrift No. 2,628,526 describes lubricating oil formulations for gas turbines and jet engines based on pentaerythritol and trimethylol propane esters of saturated monocarboxylic acids containing from 2 to 18, preferably from 5 to 10, carbon atoms. Cyclohexyl carboxylic acid, inter alia, is mentioned as an example of such monocarboxylic acids. Trimethylol and pentaerythritol esters of cyclohexyl carboxylic acid are described in detail in J. of Chem. and Eng. Data 7, 547 et seq (1962). The data quoted there show that pentaerythritol esters containing from 1 to 2 moles of cyclohexyl carboxylic acid per mole of esters have low cold setting points up to a total number of carbon atoms in the acid component of the esters of about 32. The viscosity-temperature behaviour of these esters is determined by the number of molecules of cyclohexyl carboxylic acid present per molecule of ester. Thus, according to the above-mentioned examples, the pentaerythritol esters containing one mole of cyclohexyl carboxylic acid have viscosity indices of from 118 to 129, whilst the viscosity indices of the esters containing 2 moles of cyclohexyl carboxylic acid per molecule of ester only amount to between 88 and 90.

A further increase in the total number of carbon atoms in the acid component of these esters to about 34 influences the lubricating properties in different ways according to the type of monocarboxylic acids used. The use of only a medium-chain fatty acid ($C_9$), in addition to the cyclohexyl carboxylic acid, gives an oil having a cold-setting point of −20° C. and a viscosity index of 127, while the use of a mixture of 1 mole of tetradecanoic acid with 1 mole of cyclohexyl carboxylic acid and 2 moles of hexanoic acid produces an ester oil having a cold setting point of +4° C. and a viscosity index of 129.

By contrast, a further increase in the total number of carbon atoms in the acid component of the pentaerythritol ester by 4 to 38 and more cannot be expected to give esters having cold setting points below 0° C., becuase, for example, the mere transition from pentaerythritol tetraheptanoate to pentaerythritol tetraoctanoate increases the cold setting point from −32° C. to +4° C. Neither may any significant further increase in the viscosity index be expected.

It has now surprisingly been found that ester oils having a high viscosity index and low volatility may be produced from readily obtainable starting materials based on pentaerythritol esters of "isotearic acid," cyclohexyl carboxylic acid and other aliphatic, saturated $C_6$–$C_{16}$ monocarboxylic acids, providing the total number of carbon atoms per molecule of pentaerythritol ester amounts to between 47 and 51 and providing at least 22 equivalent % of the alcoholic hydroxyl groups present in the pentaerythritol are esterified with "isostearic acid" and with cyclohexyl carboxylic acid. "Isostearic acid" is a mixture of slightly methyl-branched $C_{18}$ fatty acids which contains, for example, 16-methyl heptadecanoic acid, as described in the Unilever-Emery pamphlet "Unem 5680." Ester oils of pentaerythritol and "isostearic acid" as sole acid component are substances which are solid at room temperature.

The present invention related to ester oils of:

(a) pentaerythritol;
(b) cyclohexyl carboxylic acid;
(c) "isostearic acid"; and
(d) at least one other saturated aliphatic monocarboxylic acid containing from 6 to 16 carbon atoms;

characterised in that the total number of carbon atoms per ester molecule amounts to between 47 and 51, from 22 to 54 equivalent % of the alcoholic hydroxyl groups present in the pentaerythritol being esterified with cyclohexyl carboxylic acid, from 22 to 40 equivalent % with "isostearic acid" and from 20 to 56 equivalent % with $C_6$–$C_6$ monocarboxylic acids and the ester containing esterified cyclohexyl carboxylic acid in a quantity at least equivalent to the "isostearic acid." It was surprising and by no means foreseeable that certain pentaerythritol esters which contain on average from 47 to 51 carbon atoms per molecule of tetra-ester and which are obtained by esterification with a mixture of "isostearic acid", cyclohexyl carboxylic acid and other aliphatic, saturated $C_6$–$C_{16}$ monocarboxylic acids, would not only have cold setting points distinctly below 0° C., but would also clearly surpass the known pentaerythritol cyclohexyl carboxylic acid esters in the viscosity-temperature behaviour thereof.

According to the present invention, at least 22 equivalent % of the four primary alcoholic hydroxyl groups present in the pentaerythritol molecule should be esterified with "isostearic acid" and at least another 22 equivalent % of the hydroxyl groups should be esterified with cyclohexyl carboxylic acid, although at most 80 equivalent % of the four hydroxyl groups should be reacted with the "isostearic acid"/cyclohexyl carboxylic acid mixture. The molar ratio of "isostearic acid" to cyclohexyl carboxylic acid in the final ester may vary between 1.0:1.0 and 1.0:2.1. The third acid constituent of the pentaerythritol esters according to the present invention are aliphatic saturated, preferably straight-chain, monocarboxylic acids which contain from 6 to 16 carbon atoms. All the hydroxyl groups present in the pentaerythritol are preferably esterified as completely as possible, although the hydroxyl number of the final ester oil may vary from 0 to 8 mg KOH/g.

Pentaerythritol may be used both in pure form and also in technical quality.

The "isostearic acid" is a mixture of slightly branched saturated monocarboxylic acids of the type commercially available, for example, under the name "Unimac 5680."

The cyclohexyl carboxylic acid may be used alone or with a small content of benzoic acid for producing the esters according to the present invention.

Examples of other suitable aliphatic saturated monocarboxylic acids include: caproic acid, oenanthic acid, caprylic acid, pelargonic acid, capric acid, undecanoic acid, lauric acid, tridecanoic acid, myristic acid, pentadecanoic acid and palmitic acid.

The esterification reaction by which the esters according to the present invention are prepared is carried out in the absence or presence of an azeotrope-forming solvent under an inert gas atmosphere at temperatures of from 50° to 260° C., preferably from 140° to 220° C. Suitable inert gases are, for example, nitrogen, carbon dioxide or noble gases. Suitable catalysts for the reaction include: organic sulphonic acids, sulphuric acid, phosphoric acid, acid salts thereof, such as hydrogen sulphates and dihydrogen phosphates, phosphonic acid esters or dialkyl tin dioxides used in catalytic quantities. From 0.8 to 1.3, preferably from 1 to 1.2, equivalents of acid groups are used per equivalent of OH-groups. Suitable azeotrope-forming solvents include: aromatic hydrocarbons, such as benzene, toluene, xylene, chlorobenzene, or halogen-containing hydrocarbons, such as carbon tetrachloride or chloroform.

Esterification is carried out either in stages by initially introducing the less volatile monocarboxylic acids, subsequently adding the volatile monocarboxylic acids in a slight excess after an acid number of <5 mg KOH/g has been reached and then completing the reaction, or by reacting pentaerythritol together with all the monocarboxylic acid components until the final acid number of the ester oil derived from the monocarboxylic acid excess is obtained.

The solvent, excess acid and catalyst are removed by suitable operations, such as filtration, high vacuum distillation, stripping, thin layer evaporation and treatment with alkali or methanol.

The esters according to the present invention may be used as base stock for the production of liquid or paste-like lubricants. They are also suitable for admixture with other synthetic or mineral base lubricating oils.

The esters according to the present invention are distinguished by high flash points and low evaporation losses, increased basic viscosities in relation to comparison esters and also by very high viscosity indices, as shown by the following Examples:

COMPARISON EXAMPLE 1

Ester of pentaerythritol/lauric acid/2-ethyl hexanoic acid, molar ratio 1:2:2.
Total number of carbon atoms: 45
Kinematic viscosity at 50° C.: 29.0 cSt; at 100° C.: 7.0 cSt;
Evaporation loss (after 100 h/200° C. in an open porcelain dish): 15.4%
Cold setting point: −8° C.
Flash point: 265° C.
Viscosity index ext.: 124.

EXAMPLE

Ester of pentaerythritol/isostearic acid/cyclohexyl carboxylic acid/lauric acid, molar ratio 1:1:2:1.
Total number of carbon atoms: 49
Kinematic viscosity at 50° C.: 79.4 cSt; at 100° C.: 16.7 cSt;
Evaporation loss after 100 h/200° C. in an open porcelain dish: 5.1%
Cold setting point: −10° C.
Flash point: >300° C.
Viscosity index ext.: 149.

COMPARISON EXAMPLE 2

Ester of pentaerythritol/isostearic acid/cyclohexyl carboxylic acid/lauric acid, molar ratio 1:0.7:2.4:0.9.
Total number of carbon atoms: 45.2 (mean) value)
Kinematic viscosity at 50° C.: 109.8 cSt; at 100° C.: 18.15 cSt
Cold setting point: −22° to −23° C.
Flash point: 278° C.
Viscosity index ext.: 109.

COMPARISON EXAMPLE 3

Ester of pentaerythritol/isostearic acid/cyclohexyl carboxylic acid/lauric acid, molar ratio 1:1.2:1.4:1.4.
Total number of carbon atoms: 53.2 (mean value)
Kinematic viscosity at 50° C.: 69.15 cSt; at 100° C.: 13.92 cSt
Cold setting point: −4° to −5° C.
Flash point: 274° C.
Viscosity index ext.: 129.

COMPARISON EXAMPLE 4

Ester of pentaerythritol/stearic acid/cyclohexyl carboxylic acid/lauric acid, molar ratio 1:1:2:1.
Total number of carbon atoms: 49
Cold setting point: +32° C.

Comparison Example 4 shows that replacement of the isostearic acid by another aliphatic monocarboxylic acid containing 18 carbon atoms leads to a distinctly higher cold setting point and hence to considerably poorer flow properties of the oils.

Under oxidising conditions and at high temperatures, for example in the ageing test according to IP 48/DIN 51352, the oils according to the present invention are degraded to a lesser extent, with elimination of liquid constituents, than, for example, pentaerythritol-tetra-(2-hexyl)-decanoate, an oil according to the prior art as represented by German Offenlegungsschrift No. 2,302,918, as shown by the following Table:

Table 1

(Ageing test according to DIN 51352 (12 h at 220° C., 15 1/h of air)

| | Evaporation loss [%] | Increase in kinematic viscosity at 37.8° C. [%] |
|---|---|---|
| Example | 8.9 | 830 |
| Pentaerythritol-tetra-(2-hexyl)-decanoate | 21.2 | 1610 |

Table 2 below is a comparison of the properties of the two pentaerythritol esters A and B with the largest total number of carbon atoms from the Journal of Chemical and Engineering Data 7, 547 et seq (1962) and the ester oil of the Example according to the present invention.

| | Ester A | Ester B | Ester of the Example according to the present invention |
|---|---|---|---|
| Other monocarboxylic acids present | Caproic acid Myristic acid | Pelargonic acid | "Isostearic acid" Lauric acid |
| Molar ratio of cyclohexyl carboxylic acid to other carboxylic acids | 1:2:1 | 1:3 | 2:1:1 |
| Total number of carbon atoms | 38 | 39 | 49 |
| Cold setting point | +4° C. | −20° C. | −10° C. |
| Viscosity index ($VI_E$) | 129 | 127 | 149 |
| Kinematic viscosity at 100° C. | 8.5 cSt | 7.8 cSt | 16.7 cSt |

As this Table shows, it cannot be expected from the esters A and B known from the literature that the simultaneous use of fatty acids containing 10 or more carbon atoms, as required for increasing the total number of carbon atoms, would give esters having cold setting points about −10° C. and viscosity indexes of greater than 130. Thus, replacement of the pelargonic acid in ester B by a mixture of caproic acid and myristic acid (ester A), leads to an increase in the cold setting point to values above 0° C. By contrast, the ester according to the present invention which contains 10 carbon atoms more and a $C_{18}$-fatty acid in bound form has a viscosity index value of almost 150 and a cold setting point about −10° C.

Comparison Examples 2 and 3 show that ester oils of similar composition containing less than 47 and more than 51 carbon atoms per molecule no longer give the combination of a good cold setting point and a high viscosity index characteristic of the oil according to the present invention. Although comparison oil 2 containing on average 45 carbon atoms per molecule has a low cold setting point, its viscosity index, at 109, is considerably lower than that of comparison oil 3 and the oil according to the present invention. Oil 3, which contains on average 53 carbon atoms per molecule, has a viscosity index of only 129 (20 units lower than the oil according to the present invention) and also a cold setting point between −10° and 0° C., i.e. higher than that of the oil according to the present invention.

PRODUCTION EXAMPLES

COMPARISON EXAMPLE 1

204 g of pentaerythritol, 600 g of lauric acid and 26 g of tri-n-butyl phosphate are refluxed for 10 hours in 100 ml of xylene using a water separator. Thereafter, the acid number has fallen to below 4 mg KOH/g. After the addition of 475 g of 2-ethyl hexanoic acid and a reaction time of about 50 hours, the esterification reaction is complete. The reaction mixture is initially freed from xylene in a water jet vacuum, subsequently extracted using 10% by weight sodium hydroxide solution to remove the excess acid, washed with water until virtually neutral, and subsequently distilled. Final acid number: 0.1 mg KOH/g.

Yield 823 g.

EXAMPLE

The procedure is as in Comparison Example 1, starting with 163.2 g of pentaerythritol, 307.2 g of cyclohexane carboxylic acid, 340.8 g of "isostearic acid" and 23 g of tri-n-butyl phosphate. After a reaction time of 20 hours in the first stage, 336 g of lauric acid are added, followed by reaction for 6 hours in the second stage. After extraction using methanol, followed by distillation, the final acid number amounts to 0.1 and the yield to 859 g.

COMPARISON EXAMPLE 2

The procedure is as in Example 1, starting with 108.8 g of pentaerythritol, 245.8 g of cyclohexane carboxylic acid, 159.0 g of "isostearic acid" and 10 g of tri-n-butyl phosphate. After a reaction time of 10 hours in the first stage, 176.0 g of lauric acid are added, followed by reaction for 6 hours in the second stage. After extraction using methanol, followed by distillation, the final acid number amounts to 0.3 and the yield to 560 g.

COMPARISON EXAMPLE 3

The procedure is as in Comparison Example 2, starting with 108.8 g of pentaerythritol, 143.4 g of cyclohexane carboxylic acid, 272.6 g of "isostearic acid" and 10 g of tri-n-butyl phosphate. After a reaction time of 4 hours in the first stage, 246.4 g of lauric acid are added, followed by reaction for 6 hours in the second stage.

Final acid number 0.2; yield 671 g.

COMPARISON EXAMPLE 4

The procedure is as in Example 1, starting with 136 g of pentaerythritol, 256 g of cyclohexane carboxylic acid, 284 g of stearic acid and 4.5 g of dibutyl tin oxide. After a reaction time of 6 hours in the first stage, 240 g of lauric acid are added, followed by reaction for 4 hours in the second stage. After extraction using dilute sodium hydroxide, the final acid number amounts to approximately 0.5 and the yield to 690 g.

What we claim is:

1. An ester base stock which comprises pentaerythritol, cyclohexyl carboxylic acid, "isostearic acid" and at least one other $C_6$–$C_{16}$ saturated aliphatic monocarboxylic acid, the number of carbon atoms per ester molecule being between 47 and 51, from 22 to 54 equivalent % of the alcoholic hydroxyl groups being esterified with cyclohexyl carboxylic acid, from 22 to 40 equivalent % with "isostearic acid" and from 20 to 56 equivalent % with at least one other $C_6$–$C_{16}$ saturated aliphatic monocarboxylic acid and the content of esterfied cyclohexyl carboxylic acid being at least equivalent to that of "isostearic acid."

* * * * *